US011047159B2

(12) United States Patent
Liang et al.

(10) Patent No.: US 11,047,159 B2
(45) Date of Patent: Jun. 29, 2021

(54) DOOR HINGE HAVING BUFFERING FUNCTION

(71) Applicant: Peiling Liang, Foshan (CN)

(72) Inventors: Yelin Liang, Foshan (CN); Qingjun Lao, Foshan (CN); Haihui Zhu, Foshan (CN)

(73) Assignee: PEILING LIANG, Foshan (CN)

( * ) Notice: Subject to any disclaimer, the term of this patent is extended or adjusted under 35 U.S.C. 154(b) by 0 days.

(21) Appl. No.: 16/498,878

(22) PCT Filed: Jan. 8, 2018

(86) PCT No.: PCT/CN2018/071730

§ 371 (c)(1),
(2) Date: Sep. 27, 2019

(87) PCT Pub. No.: WO2018/214517

PCT Pub. Date: Nov. 29, 2018

(65) Prior Publication Data

US 2020/0115941 A1 Apr. 16, 2020

(30) Foreign Application Priority Data

May 25, 2017 (CN) ..... 201710378852.8

(51) Int. Cl.

| | |
|---|---|
| ***E05F 3/20*** | (2006.01) |
| ***E05D 11/08*** | (2006.01) |
| ***E05D 3/14*** | (2006.01) |

(52) U.S. Cl.

CPC ..... *E05D 11/087* (2013.01); *E05D 3/142* (2013.01)

(58) Field of Classification Search

CPC ..... E05D 11/087; E05D 3/142

See application file for complete search history.

(56) References Cited

U.S. PATENT DOCUMENTS 5,655,261 A * 8/1997 Cress ..... E05D 5/08 16/286
8,561,262 B1 * 10/2013 Liang ..... E05F 5/04 16/286

(Continued)

FOREIGN PATENT DOCUMENTS

CN 101512088 A 8/2009
CN 204326795 U 5/2015

(Continued)

OTHER PUBLICATIONS

The International Search Report and the Written Opinion for PCT/CN2018/071730 dated Apr. 13, 2018, ISA/CN, Beijing, China.

*Primary Examiner* — Jason W San

(74) *Attorney, Agent, or Firm* — M&B IP Analysts, LLC

(57) ABSTRACT

Disclosed is a door hinge having a buffering function, including: a casing within which a damper is disposed in an axially movable manner, an end portion of a piston rod at the front end of the damper being fixedly connected to the casing; a hinge cup; a linking member A with a right end rotatably disposed inside the casing via a first rotating shaft and a left end rotatably connected to the hinge cup via a third rotating shaft; and a connecting member B with a right end rotatably disposed inside the casing via a second rotating shaft and a left end rotatably connected to the hinge cup via a fourth rotating shaft. The end portion at the right end of the linking member A or the connecting member B is disposed corresponding to the rear end of the damper.

11 Claims, 4 Drawing Sheets

(56) References Cited

U.S. PATENT DOCUMENTS 9,163,447 B1* 10/2015 Liang ..... E05F 3/20
9,169,681 B2* 10/2015 Cooper ..... E05F 5/006
10,081,975 B2* 9/2018 Cooper ..... E05F 5/02
10,214,951 B2* 2/2019 Liang ..... E05F 3/20
10,458,168 B2* 10/2019 Hammerer ..... E05D 11/1021
2011/0072617 A1* 3/2011 Lin ..... E05F 5/006 16/298
2011/0225768 A1* 9/2011 Haemmerle ..... E05D 3/16 16/49
2011/0291538 A1* 12/2011 Brunnmayr ..... E05F 5/006 312/326
2011/0298349 A1* 12/2011 Sutterlutti ..... E05F 5/006 312/326
2012/0060325 A1* 3/2012 Lin ..... E05D 11/084 16/327
2012/0174338 A1* 7/2012 Wu ..... E05F 5/006 16/297
2013/0019713 A1* 1/2013 Krudener ..... E05D 11/00 74/99 R
2013/0145580 A1* 6/2013 Brunnmayr ..... E05F 5/006 16/277
2013/0160242 A1* 6/2013 Brunnmayr ..... E05F 5/04 16/286
2013/0239363 A1* 9/2013 Apur ..... E05F 5/006 16/50
2014/0352111 A1* 12/2014 Ng ..... E05F 5/02 16/286
2014/0366322 A1* 12/2014 Salice ..... E05F 5/006 16/277
2015/0330128 A1* 11/2015 Ng ..... E05D 7/0407 16/65
2016/0138319 A1* 5/2016 Wu ..... E05D 7/0415 16/50
2016/0153224 A1* 6/2016 Salice ..... E05F 5/02 16/52
2016/0273258 A1* 9/2016 Pecar ..... E05F 5/02
2018/0135344 A1* 5/2018 Liang ..... E05D 3/142

FOREIGN PATENT DOCUMENTS

CN 105604423 A 5/2016
CN 105781291 A 7/2016
CN 107013118 A 8/2017

* cited by examiner

DOOR HINGE HAVING BUFFERING FUNCTION

CROSS-REFERENCE TO RELATED APPLICATIONS

This application is the United States National Stage entry under 35 U.S.C. 371 of International Application PCT/CN2018/071730 filed on Jan. 8, 2018, which claims the benefit of Chinese patent application No. 2017103788528 filed on May 25, 2017. All of the applications referenced above are herein incorporated by reference.

TECHNICAL FIELD

The disclosure relates to the field of door hinge technologies, and more particularly, to a door hinge having a buffering function.

BACKGROUND

The wide application of door hinges is well known. Although it is relatively traditional hardware, it has also undergone a technological development process. A more primitive door hinge, such as a loose-leaf, is set such that it has no buffering effect when a door is opened and closed, resulting in that the door collides with walls and other objects, which has a poor use effect.

In order to effectively solve the technical problem above, a door hinge having a buffering function has emerged at the right moment. For example, the solution described in Chinese patent publication number CN105604423A discloses a door hinge having a buffering function, which includes a casing, a buffering shaft and a first torsion spring. The buffering shaft, with a buffering block arranged thereon, is rotatably disposed in the casing. The first torsion spring is sleeved on the buffering shaft, with one end of the first torsion spring abutted against the casing and the other end of the first torsion spring abutted against the buffering block on the buffering shaft. The existing solutions further include a second torsion spring, a linking member and a second rotating shaft. The linking member has one end rotationally connected to a hinge cup via the other shaft of the U-shaped rotating shaft and the other end rotationally disposed in the casing via the second rotating shaft. An end portion of the buffering block may be abutted with the linking member. The existing solution above achieves the buffering effect by cooperation of the linking member and the buffering block, which effectively solves the technical problem of the traditional technologies. However, the existing solution still has the technical defects as follows. The buffering block rotates with the buffering shaft as a center, thus the linking member has a short stroke when the buffering block is abutted with the linking member, resulting in a yet poor buffering effect.

Therefore, there still has a room for improvement in the existing solutions.

SUMMARY

The disclosure is intended to provide a door hinge having a buffering function, which has the advantages of reasonable structural disposition, good buffering effect, and the like.

In order to achieve the objects above, the following technical solutions are adopted in the disclosure.

The door hinge having a buffering function according to the disclosure includes: a casing in which a damper is disposed in an axially movable manner, an end portion of a piston rod at a front end of the damper being fixedly connected to the casing; a hinge cup; a linking member A with a right end rotatably disposed in the casing via a first rotating shaft and a left end rotatably connected to the hinge cup via a third rotating shaft; and a connecting member B with a right end rotatably disposed inside the casing via a second rotating shaft and a left end of the connecting member B rotatably connected to the hinge cup via a fourth rotating shaft, the second rotating shaft being sleeved with a torsion spring with one end fixed to or abutted against the fourth rotating shaft and the other end abutted against the casing, one of an end portion at the right end of the linking member A and an end portion at a right end of the connecting member B being disposed corresponding to a rear end of the damper.

The casing is provided with a positioning block at an inner wall at both front and rear sides, two sliding slots are formed between two positioning blocks and a top wall of the casing, and the damper is disposed, by both sides of the damper, in the two sliding slots in an axially slidable manner.

The damper is provided with a positioning slider at both sides, and the damper is in slide fit with the two sliding slots correspondingly via the positioning slider at both sides.

The casing is internally and fixedly provided with a positioning shaft, the end portion of the piston rod of the damper is provided with a hook, and the hook is hung on the positioning shaft for positioning.

A top portion of the casing is provided with a downwardly extending clamping piece, the end portion of the piston rod of the damper is provided with a clamping slot, and the clamping slot is clamped on the clamping piece for positioning.

An end portion at the rear end of the damper is provided with a stopper, the end portion at the right end of the linking member A is provided with a driving member corresponding to the stopper.

The driving member is a pushing block or a lifting hook.

An end portion at the rear end of the damper is provided with an inclined surface, the end portion at the right end of the connecting member B is provided with a driving member corresponding to the inclined surface.

The driving member is a pushing block matched with the inclined surface.

One of the end portion at the right end of the linking member A or the end portion at the right end of the connecting member B is provided with the driving member, and the end portion at the rear end of the damper is hinged with the driving member.

The positioning block is an inwardly bent folding piece or bulge punched and inwardly stamped at front and rear sides of the casing respectively.

The third rotating shaft and the fourth rotating shaft are integrally formed into a U-shaped rotating shaft.

According to the disclosure, the damper is disposed in the casing in an axially movable manner, and the end portion of the piston rod at the front end of the damper is fixedly connected to the casing; and the end portion at the right end of the linking member A or the end portion at the right end of the connecting member B is disposed corresponding to the rear end of the damper. The damper of the disclosure has the same moving direction as the linking member A or the connecting member B, which greatly extends a stroke of the linking member A or a stroke of the connecting member B, thus achieving a better buffering technical effect.

Figure 1:
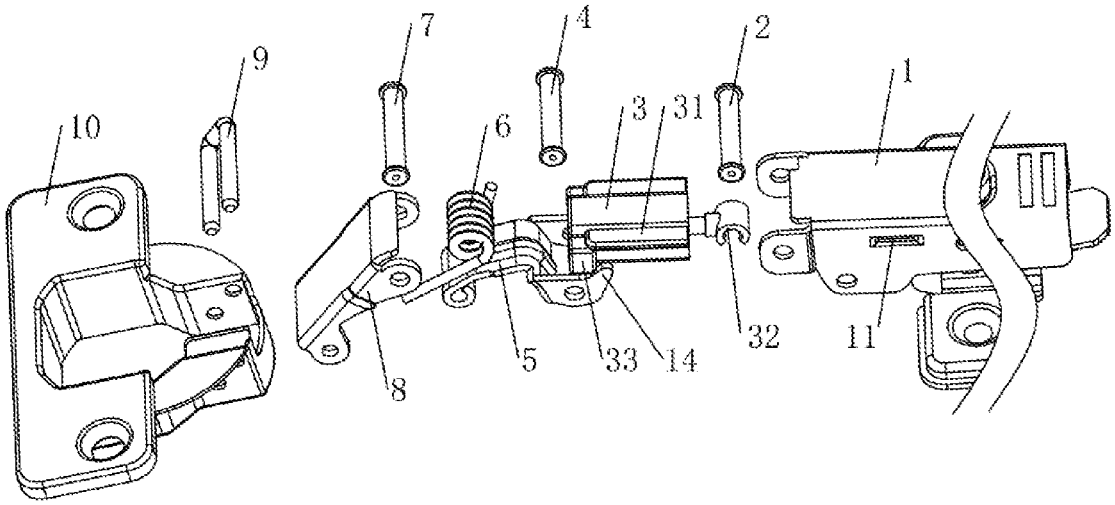
FIG. 1 is a decomposed structure diagram of a first embodiment of the disclosure.

In the drawings, the reference numbers refer to the following corresponding features: 1 refers to casing; 2 refers to positioning shaft; 3 refers to damper; 4 refers to first rotating shaft; 5 refers to linking member A; 6 refers to torsion spring; 7 refers to second rotating shaft; 8 refers to connecting member B; 9 refers to U-shaped rotating shaft; 10 refers to hinge cup; 11 refers to positioning block; 12 refers to sliding slot; 13 refers to clamping piece; 14 refers to driving member; 31 refers to positioning slider; 32 refers to hook; 33 refers to stopper; 34 refers to clamping slot; and 35 refers to inclined surface.

DETAILED DESCRIPTION

The technical solutions of the disclosure are further described below with reference to the drawings.

Figure 2:
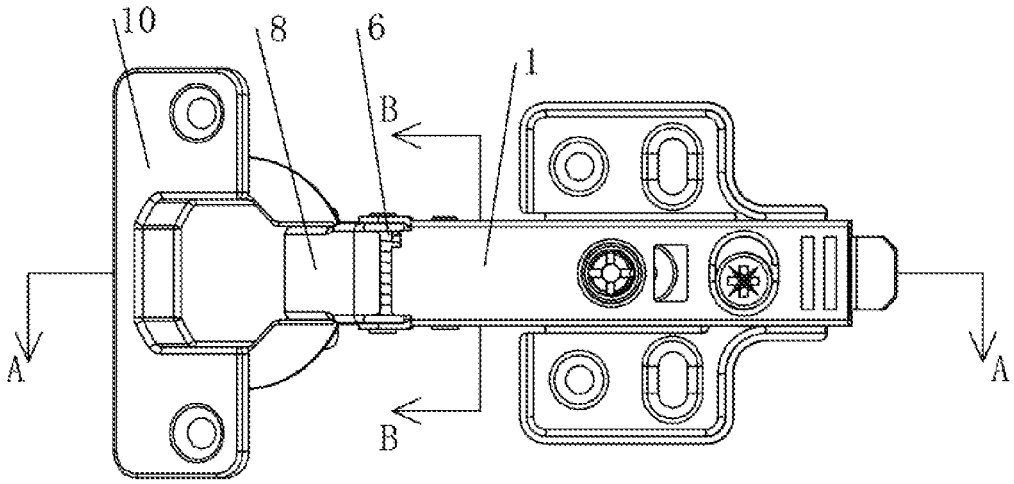
FIG. 2 is an overall structure diagram of the first embodiment of the disclosure.
Figure 3:
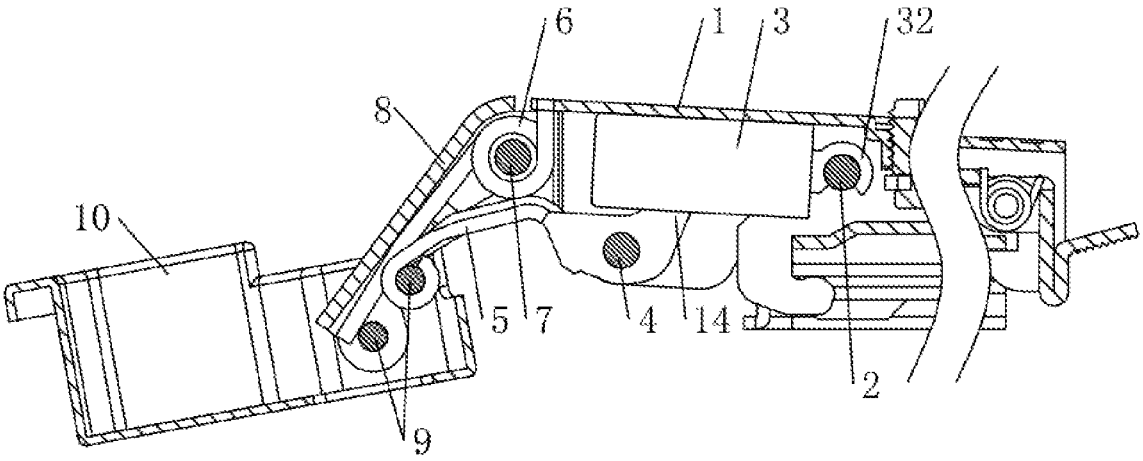
FIG. 3 is a sectional view of A-A in FIG. 2.
Figure 4:
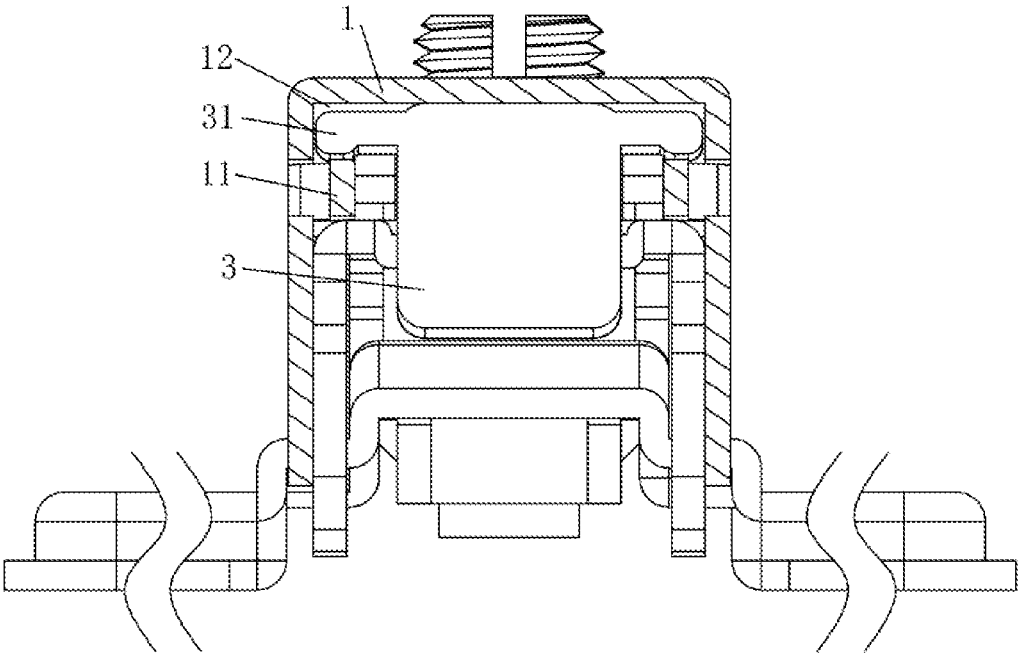
FIG. 4 is a sectional view of B-B in FIG. 2.
Figure 5:
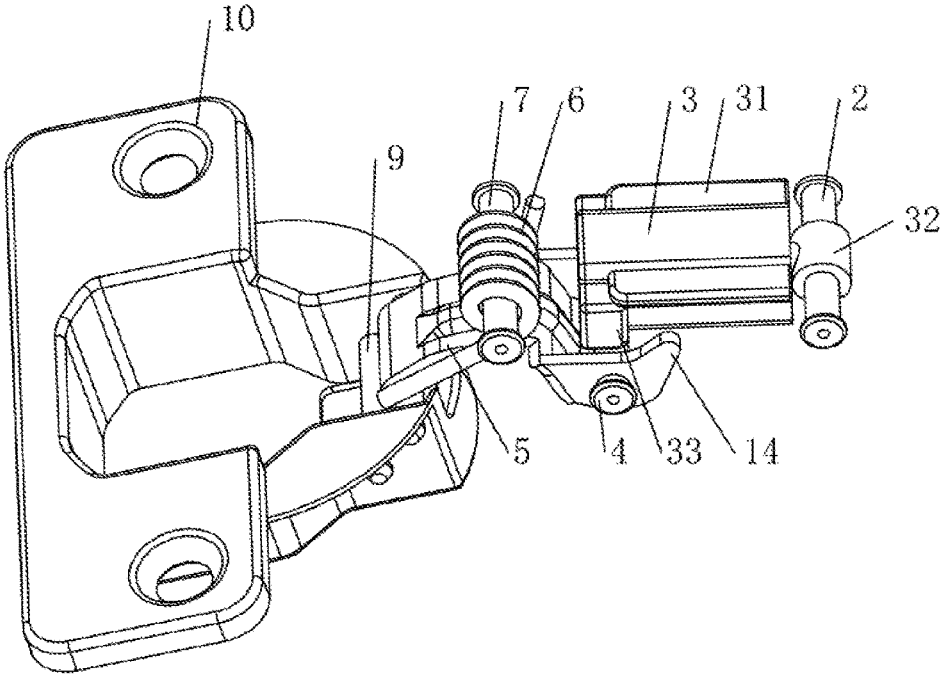
FIG. 5 is a structure diagram of the first embodiment of the disclosure without a casing and a connecting member.
Figure 6:
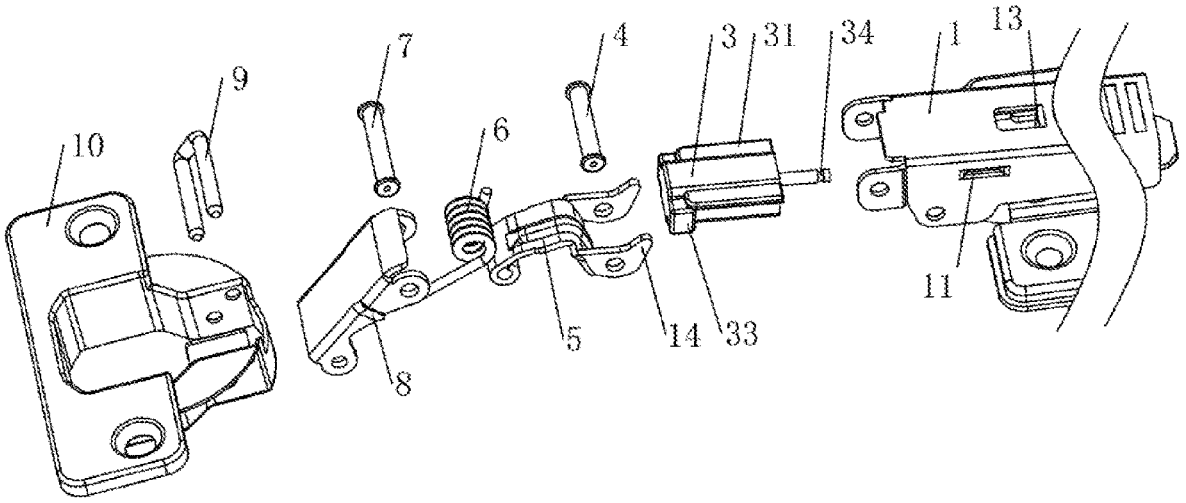
FIG. 6 is a decomposed structure diagram of another implementation of the first embodiment of the disclosure.
Figure 7:
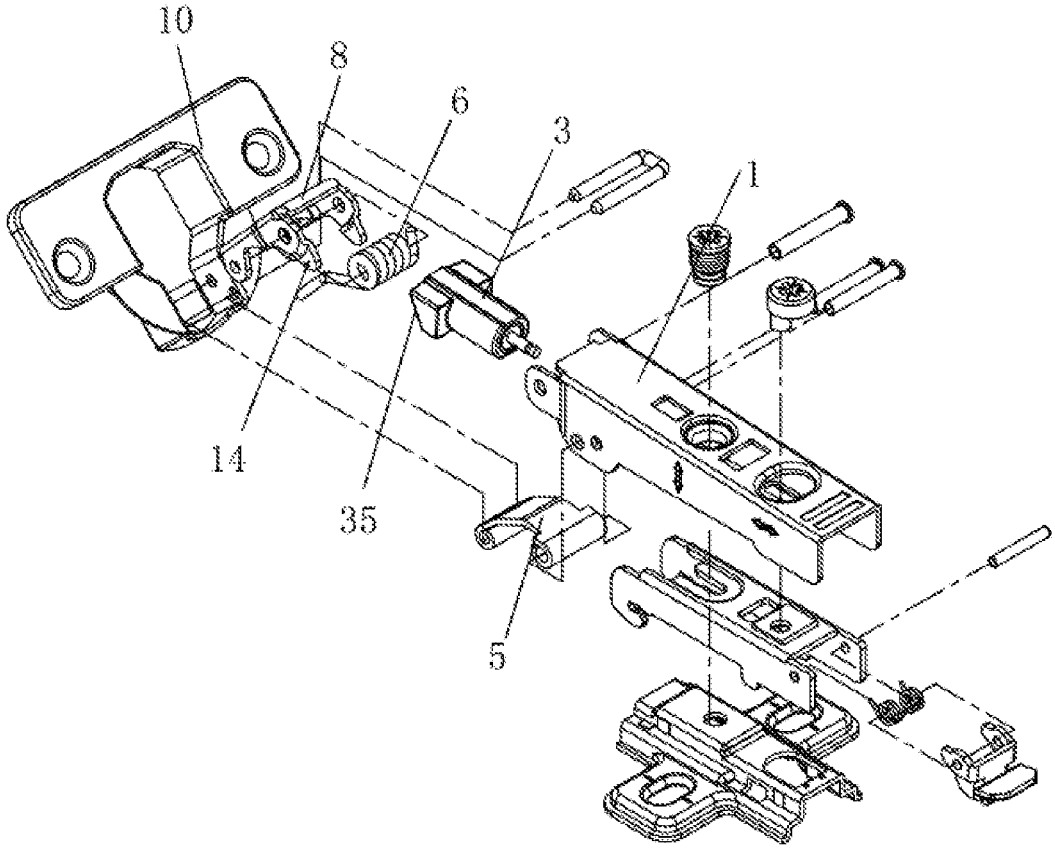
FIG. 7 is a decomposed structure diagram of a second embodiment of the disclosure.
Figure 8:
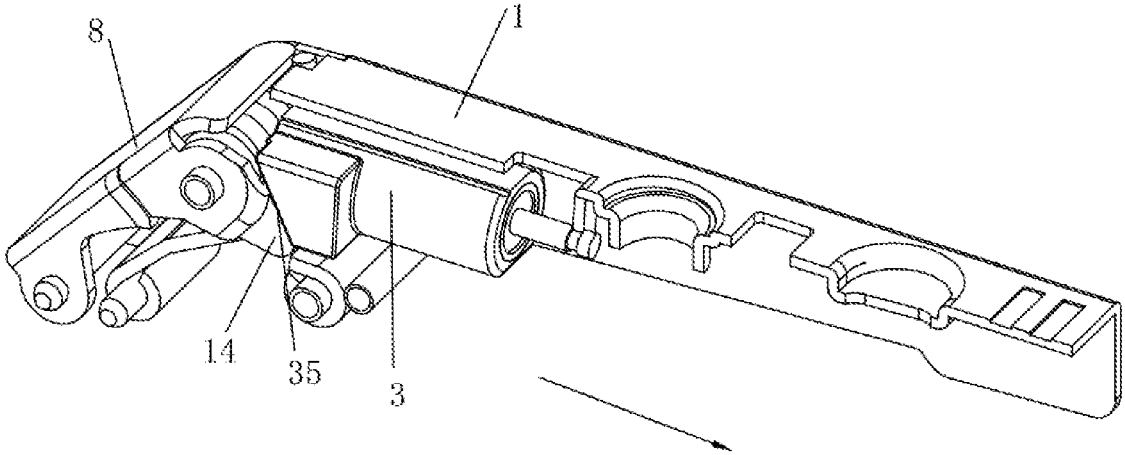
FIG. 8 is an assembly structure diagram of partial components according to the second embodiment of the disclosure.

In an embodiment, as shown in FIGS. 1 to 6, a door hinge having a buffering function includes a casing 1, a hinge cup 10, a linking member A5 and a connecting member B8, wherein a damper 3 is disposed in the casing 1 in an axially movable manner, an end portion of a piston rod at a front end of the damper 3 is fixedly connected to the casing 1.

A right end of the linking member A5 is rotatably disposed in the casing 1 via a first rotating shaft 4, while a left end of the linking member A5 is rotatably connected to the hinge cup 10 via a third rotating shaft. A right end of the connecting member B8 is rotatably disposed inside the casing 1 via a second rotating shaft 7, while a left end of the connecting member B8 is rotatably connected to the hinge cup 10 via a fourth rotating shaft.

A torsion spring 6 is sleeved on the second rotating shaft 7, one end of the torsion spring 6 is fixed to or abutted against the fourth rotating shaft, and the other end of the torsion spring 6 is abutted against the casing 1. An end portion at the right end of the linking member A5 is disposed corresponding to a rear end of the damper 3.

In particular, in order to improve an integration level of products and simplify assembly procedures, the third rotating shaft and the fourth rotating shaft may be integrally formed into a U-shaped rotating shaft 9.

The casing 1 and the hinge cup 10 are respectively fixed on a door and a doorframe during use. When the door is opened, the end portion at the right end of the linking member A5 drives the damper 3 to move rightward to achieve a better buffering effect. When the door is closed, the torsion spring 6 is compressed, and the damper 3 moves leftward along with the linking member A5 to achieve a better buffering effect. According to the disclosure, directions in which the linking member A5 and the damper 3 move are in the same straight line, which has a large stroke, and compared with the existing solutions, has a better buffering effect.

The damper 3 is disposed in the casing 1 in an axially movable manner, specifically inner walls at front and rear sides of the casing 1 are respectively provided with a positioning block 11, two sliding slots 12 are formed between the two positioning blocks 11 and a top wall of the casing 1, and two sides of the damper 3 are disposed in the corresponding two sliding slots 12 in an axially slidable manner. In order to improve operability and flexibility, the two sides of the damper 3 are respectively provided with a positioning slider 31, and the damper 3 is in slide fit with the two sliding slots 12 correspondingly via the positioning sliders 31 on the two sides. In this way, it is simple in structure, greatly reduces the manufacturing cost, and facilitates the assembly and disassembly of the damper 3 at the same time, and the maintenance is simple and convenient, and has low cost.

It is worth mentioning that the positioning blocks 11 are inwardly bent folding pieces or bulges punched and inwardly stamped at front and rear sides of the casing 1 respectively. The structure so formed greatly simplifies the product structure, improves the operation reliability of products, and effectively reduces the cost.

An end portion of a piston rod at a front end of the damper 3 is fixedly connected to the casing 1, and specifically, two different implementations may be used in accordance with the disclosed embodiments.

The first implementation is that: the casing 1 is internally and fixedly provided with a positioning shaft 2, the end portion of the piston rod of the damper 3 is provided with a hook 32, and the hook 32 is hung on the positioning shaft 2 for positioning.

The second implementation is that: a top portion of the casing 1 is provided with a downwardly extending clamping piece 13, the end portion of the piston rod of the damper 3 is provided with a clamping slot 34, and the clamping slot 34 is clamped on the clamping piece 13 for positioning.

In both implementations above, the end portion of the piston rod of the damper 3 is detachably connected to the casing 1, which facilitates the assembly and disassembly of the damper 3, so that the maintenance is simple and convenient, and has the low cost.

An end portion at the rear end of the damper 3 is provided with a stopper 33, the end portion at the right end of the linking member A5 is provided with a driving member 14 corresponding to the stopper 33. Regarding the corresponding relationship between the driving member 14 and the stopper 33, the embodiment may have three structures: 1. the driving member 14 is a pushing block and is disposed to be abutted with the stopper 33 to drive the damper 3 to move; 2. the driving member 14 is a lifting hook that can effectively hook the stopper 33 to drive the damper 3 to move; and 3. the driving member 14 is hinged with the stopper 33 to drive the damper 3 to move.

In another embodiment, structures of the embodiment are the same as those of the first embodiment, and will not be described again, except that the driving member 14 is disposed at the end portion at the right end of the connecting member B8, and the damper 3 is driven by the driving member 14 to move axially through the rotation of the connecting member B8.

Specifically, an end portion at the rear end of the damper 3 is provided with an inclined surface 35, the end portion at the right end of the connecting member B8 is provided with a driving member 14 (a pushing block) corresponding to the inclined surface 35.

Specifically, the driving member 14 in the embodiment can be abutted and matched with the inclined surface 35, or the driving member 14 can also be hinged with the end portion at the rear end of the damper 3.

The second embodiment also has a certain difference in technical effect from the first embodiment, a torsion spring 6 is sleeved on the second rotating shaft 7 of the connecting member B8, and meanwhile, the end portion at the right end of the connecting member B8 is provided with the driving member 14 corresponding to the damper 3, and when the door is opened or closed, the torsion spring 6 cooperates with the damper 3 more directly, thus having a better buffering effect.

All examples and conditional language recited herein are intended for pedagogical purposes to aid the reader in understanding the principles of the disclosed embodiment and the concepts contributed by the inventor to furthering the art, and are to be construed as being without limitation to such specifically recited examples and conditions. Moreover, all statements herein reciting principles, aspects, and embodiments of the disclosed embodiments, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

It should be understood that any reference to an element herein using a designation such as "first," "second," and so forth does not necessarily limit the quantity or order of those elements. Rather, these designations are generally used herein as a convenient method of distinguishing between two or more elements or instances of an element. Thus, a reference to first and second elements does not mean that only two elements may be employed there or that the first element must precede the second element in some manner. Also, unless stated otherwise, a set of elements comprises one or more elements.

As used herein, the phrase "at least one of" followed by a listing of items means that any of the listed items can be utilized individually, or any combination of two or more of the listed items can be utilized. For example, if a system is described as including "at least one of A, B, and C," the system can include A alone; B alone; C alone; 2A; 2B; 2C; 3A; A and B in combination; B and C in combination; A and C in combination; A, B, and C in combination; 2A and C in combination; A, 3B, and 2C in combination; and the like.

What is claimed is:

1. A door hinge having a buffering function, comprising:

a casing;

a damper disposed in the casing, wherein the damper is disposed in an axially movable manner, the damper including a piston rod, a front end, and a rear end, wherein the piston rod has a first end portion at the front end of the damper, the first end portion of the piston rod being fixedly connected to the casing;

a hinge cup;

a first rotating shaft;

a second rotating shaft;

a third rotating shaft;

a fourth rotating shaft;

a linking member having a right end rotatably disposed in the casing via the first rotating shaft and a left end rotatably connected to the hinge cup via the third rotating shaft, wherein the right end of the linking member has a second end portion; and a connecting member having a right end rotatably disposed inside the casing via the second rotating shaft and a left end rotatably connected to the hinge cup via the fourth rotating shaft, the second rotating shaft being sleeved with a torsion spring having a first end and a second end, wherein the first end of the torsion spring is fixed to or abutted against the fourth rotating shaft, wherein the second end of the torsion spring is abutted against the casing, wherein the right end of the connecting member has a third end portion, wherein one of the second end portion at the right end of the linking member and the third end portion at the right end of the connecting member is disposed corresponding to the rear end of the damper; wherein, the damper including an end portion at the rear end of the damper, wherein the end portion at the rear end of the damper is provided with a stopper, wherein the end portion at the right end of the linking member is provided with a driving member corresponding to the stopper, and the driving member abuts against the stopper of the damper for driving the damper to move.

2. The door hinge of claim 1, the casing having a front side and a rear side, wherein the casing includes two positioning blocks and a top wall, wherein the casing is provided with a positioning block at an inner wall at the front and rear sides, wherein two sliding slots are formed between the two positioning blocks and the top wall of the casing, wherein the damper is disposed, by both sides of the damper, in the two sliding slots in an axially slidable manner.

3. The door hinge of claim 2, wherein the damper is provided with a positioning slider at both sides, wherein the damper is in slide fit with the two sliding slots correspondingly via the positioning slider at both sides.

4. The door hinge of claim 1, wherein the casing is internally and fixedly provided with a positioning shaft, wherein the end portion of the piston rod of the damper is provided with a hook, wherein the hook is hung on the positioning shaft for positioning.

5. The door hinge of claim 1, wherein a top portion of the casing is provided with a downwardly extending clamping piece, wherein the end portion of the piston rod of the damper is provided with a clamping slot, wherein the clamping slot is clamped on the clamping piece for positioning.

6. The door hinge of claim 1, wherein the driving member is any of: a pushing block and a lifting hook which protrudes upwardly towards the damper.

7. The door hinge of claim 1, the damper including an end portion at the rear end of the damper, wherein the end portion at the rear end of the damper is provided with an inclined surface, wherein the end portion at the right end of the connecting member is provided with a driving member corresponding to the inclined surface.

8. The door hinge of claim 7, wherein the driving member is a pushing block matched with the inclined surface.

9. The door hinge of claim 1, wherein one of the end portion at the right end of the linking member and the end portion at the right end of the connecting member is provided with a driving member, wherein the end portion at the rear end of the damper is hinged with the driving member.

10. The door hinge of claim 2, wherein the positioning block is an inwardly bent folding piece or bulge punched and inwardly stamped at front and rear sides, respectively, of the casing.

11. The door hinge of claim 1, wherein the third rotating shaft and the fourth rotating shaft are integrally formed into a U-shaped rotating shaft.

* * * * *